US007120944B2

(12) United States Patent
Dorsher

(10) Patent No.: US 7,120,944 B2
(45) Date of Patent: Oct. 17, 2006

(54) GRIPE MECHANISM OF A RESERVOIR TANK FOR A TOILET BOWL

(75) Inventor: Craig L. Dorsher, Norcross, GA (US)

(73) Assignee: Fusion Hardware Group, Inc., Norcross, GA (US)

( * ) Notice: Subject to any disclaimer, the term of this patent is extended or adjusted under 35 U.S.C. 154(b) by 288 days.

(21) Appl. No.: 10/873,261

(22) Filed: Jun. 23, 2004

(65) Prior Publication Data

US 2005/0283898 A1 Dec. 29, 2005

(51) Int. Cl.
*E03D 5/00* (2006.01)

(52) U.S. Cl. ..... 4/405

(58) Field of Classification Search ..... 4/405, 4/411–414

See application file for complete search history.

(56) References Cited

U.S. PATENT DOCUMENTS 5,400,445 A * 3/1995 Hull ..... 4/325
5,491,848 A * 2/1996 Wang ..... 4/405
5,680,659 A * 10/1997 Gessaman ..... 4/325
5,918,324 A * 7/1999 Hwang et al. ..... 4/324

* cited by examiner

*Primary Examiner*—Charles E. Phillips
(74) *Attorney, Agent, or Firm*—Troxell Law Office PLLC

(57) ABSTRACT

A gripe mechanism of a reservoir tank for a toilet bowl is assembled to a through hole defined in the reservoir tank. The gripe mechanism includes a bolt extending through the through hole of the reservoir tank, a position limit member locating at an inner side of the reservoir tank with the bolt extending therethrough, a positioning member, a lever, and a gripe. A plurality of positioning cutouts is evenly defined in the position limit member. A position limit frame extends from the position limit member. A screw hole is defined in the positioning member for engaging with the bolt. The gripe is connected to a projecting rod through a screw thereby linking the gripe to the lever. Movement of the lever is limited by the position limit frame of the position limit member.

7 Claims, 6 Drawing Sheets

GRIPE MECHANISM OF A RESERVOIR TANK FOR A TOILET BOWL

BACKGROUND OF THE INVENTION

1. Field of the Invention

The present invention relates to a gripe mechanism of a reservoir tank for a toilet bowl, and particularly to a gripe mechanism assembled to a through hole defined in a reservoir tank for a toilet bowl.

2. Prior Art

Nowadays, a toilet bowl has a reservoir tank for storing water. A gripe mechanism is formed at a sidewall of the reservoir tank whereby a user may switch the gripe mechanism to flush the toilet bowl with the water in the reservoir tank.

Referring to FIG. 6, a conventional gripe mechanism of a reservoir tank is shown. The gripe mechanism 40 mainly includes a position limit frame 41, a nut 42, a lever 43 and a gripe 44.

The position limit frame 41 is generally C-shaped. A screw post 411 extends from a side of the position limit frame 41. A protrusion 412 is formed between the screw post 411 and the position limit frame 41. A through hole 413 is defined in the center of the screw post 411. The screw post 411 extends through a rectangular hole 51 defined in the reservoir tank 50 and the protrusion 412 is positioned to be fittingly received in the rectangular hole 51. The nut 42 threadedly engages with the screw post 411. A mounting shaft 431 of the L-shaped lever 43 extends through the through hole 413 of the screw post 411, and then is connected to the gripe 44. Therefore, the user may pull the gripe 44 to move the lever 43 for flushing the toilet bowl.

Though the user may pull the gripe 44 to flush the toilet bowl, when the rectangular hole 51 of the reservoir tank 50 is deflective, the protrusion 412 of the position limit frame 41 positioned in the rectangular hole 51 will be deflective correspondingly. Thus, a position limit angle of the position limit frame 41 to the gripe 44 is changed, which makes a pivot position of the gripe 44 and the lever 43 changed correspondingly whereby opening or closing of a water stop valve (not shown) of the reservoir tank 50 is adversely affected. Therefore, the deflective rectangular hole 51 of the reservoir tank 50 results in inconvenience to use the gripe mechanism 40.

SUMMARY OF THE INVENTION

Accordingly, an object of the present invention is to provide a gripe mechanism of a reservoir tank for a toilet bowl which is adjustable in accordance with configuration of a mounting hole of the reservoir tank thereby keeping the gripe mechanism moving within a desirable position limitation and is ready to assemble and use.

To achieve the above-mentioned object, a gripe mechanism of a reservoir tank for a toilet bowl in accordance with the present invention is assembled to a through hole defined in the reservoir tank. The gripe mechanism includes a bolt extending through the through hole of the reservoir tank, a position limit member locating at an inner side of the reservoir tank with the bolt extending therethrough, a positioning member, a lever and a gripe. A plurality of positioning cutouts is evenly defined in the position limit member. A position limit frame extends from the position limit member. A screw hole is defined in the positioning member for threadedly engaging with the bolt. A protrusion extends from the positioning member towards the position limit member for extending through the positioning cutouts of the position limit member and the through hole of the reservoir tank. A projecting rod extends from an end of the lever for extending through the screw hole of the positioning member. The gripe is connected to the projecting rod through a screw thereby linking the gripe to the lever. Movement of the lever is limited by the position limit frame of the position limit member.

Other objects, advantages and novel features of the present invention will be drawn from the following detailed embodiment of the present invention with attached drawings, in which:

DESCRIPTION OF THE PREFERRED EMBODIMENT

Figure 1:
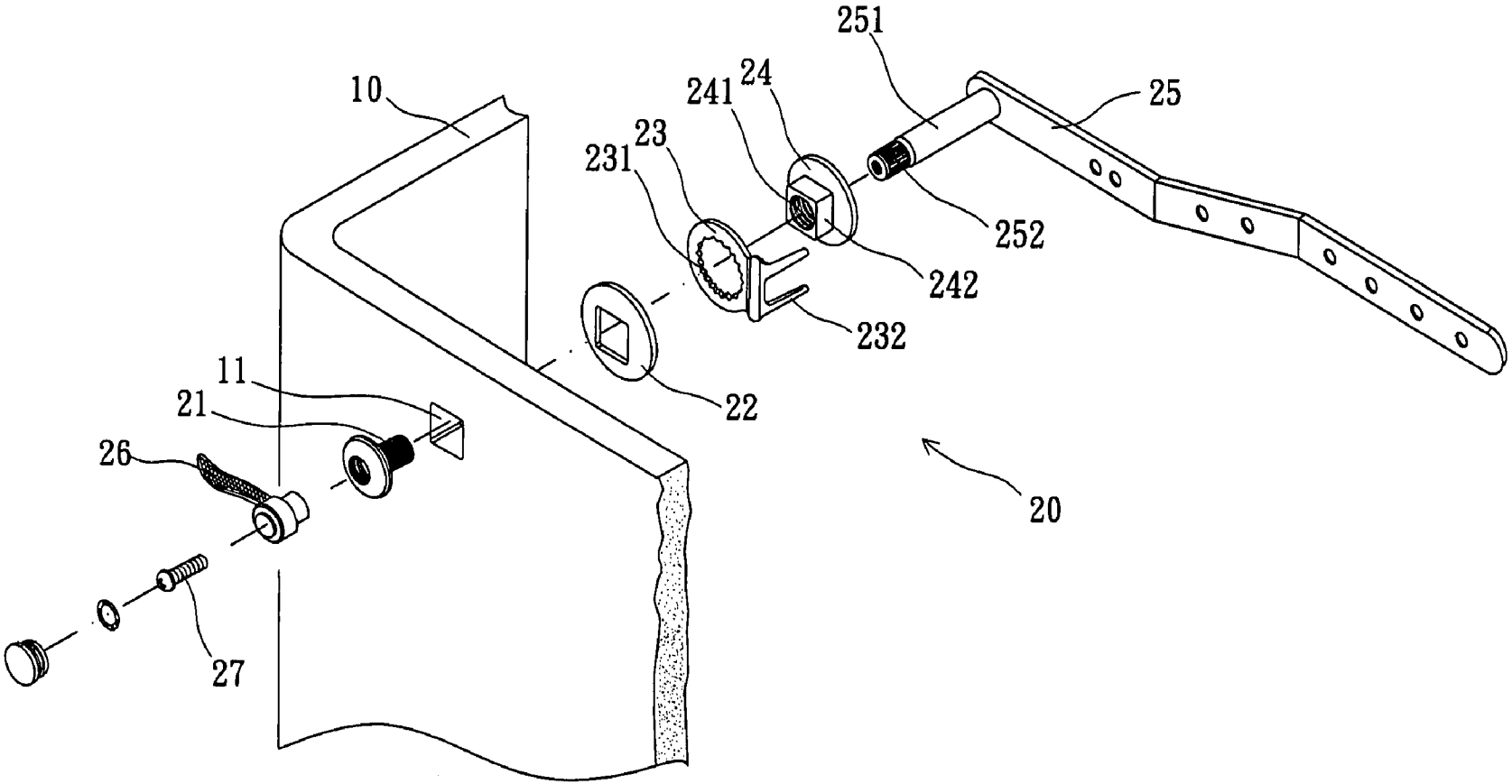
FIG. 1 is an exploded view of a gripe mechanism of a reservoir tank for a toilet bowl of the present invention.
Figure 2:
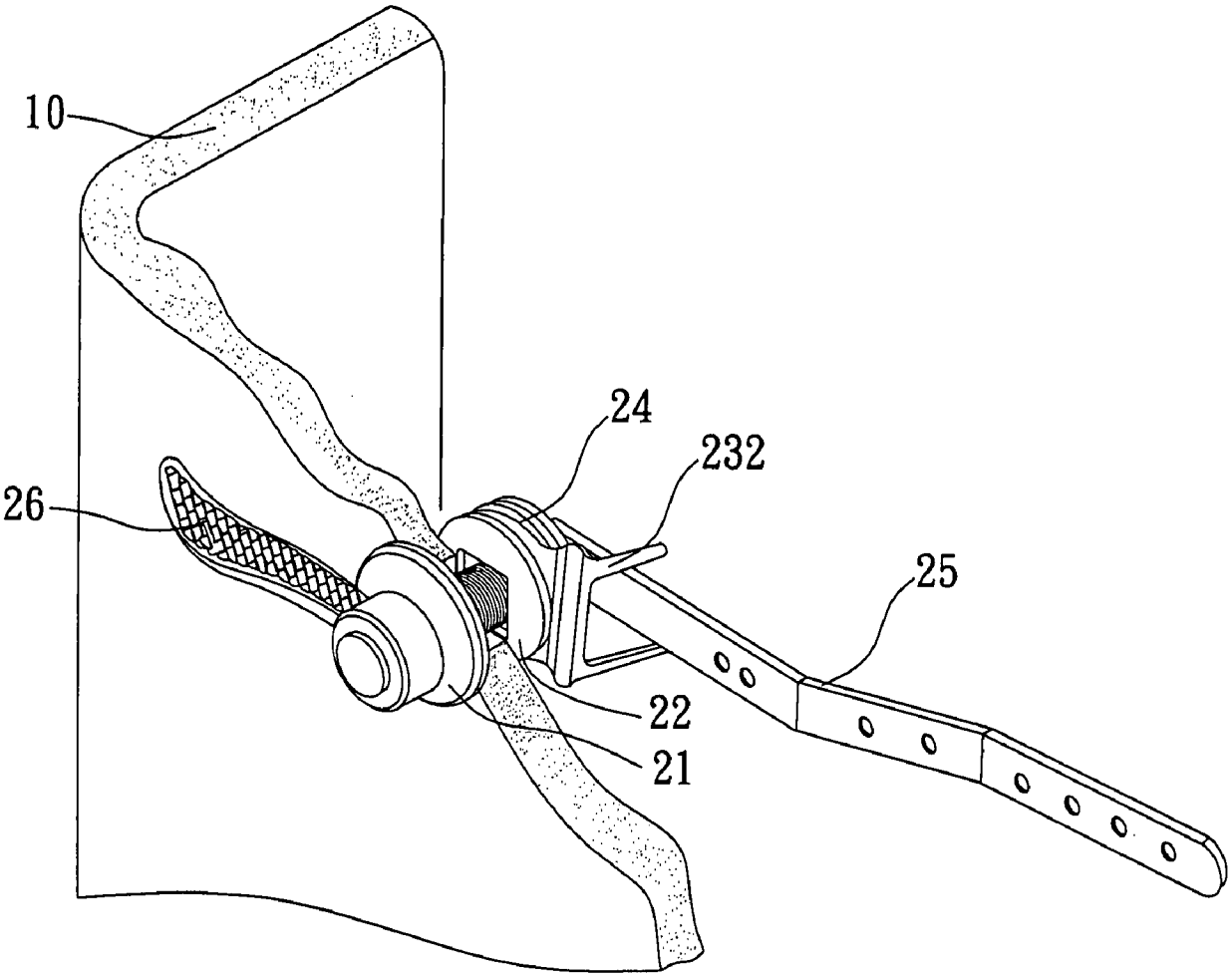
FIG. 2 is an assembled view of FIG. 1 with part of the reservoir tank cut away.
Figure 3:
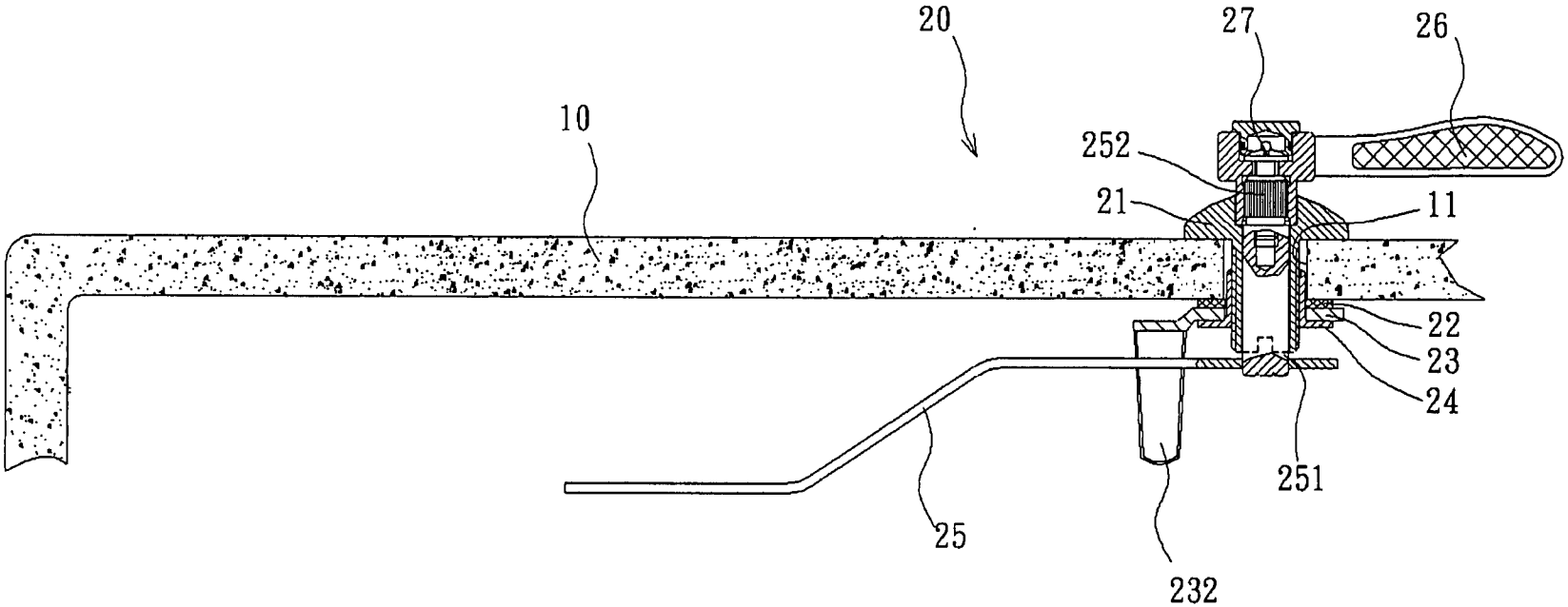
FIG. 3 is a cross-sectional view of FIG. 2.

Referring to FIGS. 1–3, a gripe mechanism 20 of a reservoir tank 10 for a toilet bowl (not shown) of the present invention is shown. A rectangular through hole 11 is defined in the reservoir tank 10 for the toilet bowl for extension of the gripe mechanism 20 whereby the gripe mechanism 20 is fixed to the reservoir tank 10. The gripe mechanism 20 mainly includes a bolt 21, a gasket 22, a position limit member 23, a positioning member 24 with a screw hole 241 defined in the center thereof, a lever 25 with a projecting rod 251 extending from an end thereof, a gripe 26 and a screw 27 (as shown in FIG. 1).

The bolt 21 extends through the through hole 11 of the reservoir tank 10 with an end thereof projecting from an inner sidewall of the reservoir tank 10 and sequentially extending through the gasket 22 and the position limit member 23. A plurality of positioning cutouts 231 are radially and evenly defined in the center of the position limit member 23. A generally C-shaped position limit frame 232 is formed at a periphery of the position limit member 23. The bolt 21 is engaged with a screw hole 241 of the positioning member 24. A rectangular protrusion 242 extends from the positioning member 24 towards the position limit member 23. The protrusion 242 extends through the positioning cutout 231 of the position limit member 23 and the gasket 22 and then is positioned to be fittingly received in the through hole 11 of the reservoir tank 10 (as shown in FIG. 3).

The screw hole 241 of the positioning member 24 is for extension of the projecting rod 251 of the lever 25. A mating portion 252 is formed at the free end of the projecting rod 251 for connecting with the gripe 26. The screw 27 extends through the gripe 26 and then threadedly engages with the mating portion 252 of the projecting rod 251 thereby fixing the gripe 26 to the projecting rod 251. Thus, the gripe 26 is linked with the lever 25. Furthermore, movement of the lever 25 and the gripe 26 is limited by the position limit frame 232 of the position limit member 23 (as shown in FIGS. 1–3).

The quantity of the positioning cutouts 231 of the position limit member 23 is configured to be a multiple of the shape of the protrusion 242 of the positioning member 24 (as shown in FIG. 1).

The position limit frame 232 generally perpendicularly extends from the position limit member 23 (as shown in FIG. 1).

Figure 4:
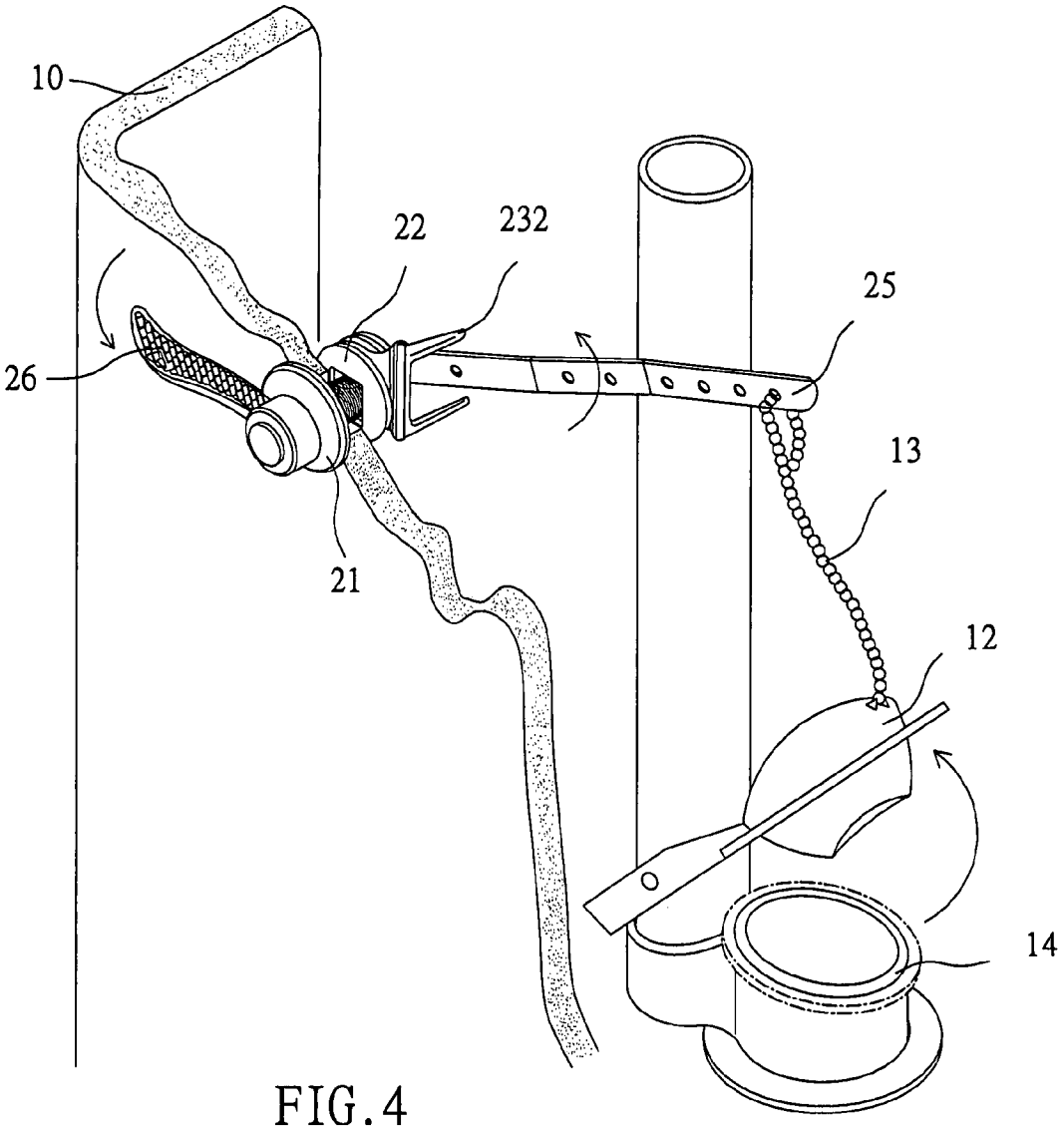
FIG. 4 is a perspective view showing the gripe mechanism is pulled to open a water stop valve.

Referring to FIGS. 1–5, the gripe mechanism 20 of the present invention is assembled to the through hole 11 of the reservoir tank 10. A connection line 13 of a water stop valve 12 of the reservoir tank 10 is fixed to the free end of the lever 25 (as shown in FIG. 4).

Since the rectangular protrusion 242 of the positioning member 24 is received in the positioning cutouts 231 of the position limit member 23 and is received in the rectangular through hole 11 of the reservoir tank 10, the position limit member 23 is fixed to the reservoir tank 10 thereby preventing from rotating when the position limit member 23 is exerted with an outside force. Therefore, a user may directly depress the gripe 26 for rotating the lever 25 to pull the connection line 13 thereby opening the water stop valve 12, and so the water in the reservoir tank 10 flows away through an outlet 14 of the reservoir tank 10 to flush the toilet bowl (as shown in FIG. 4).

Figure 5:
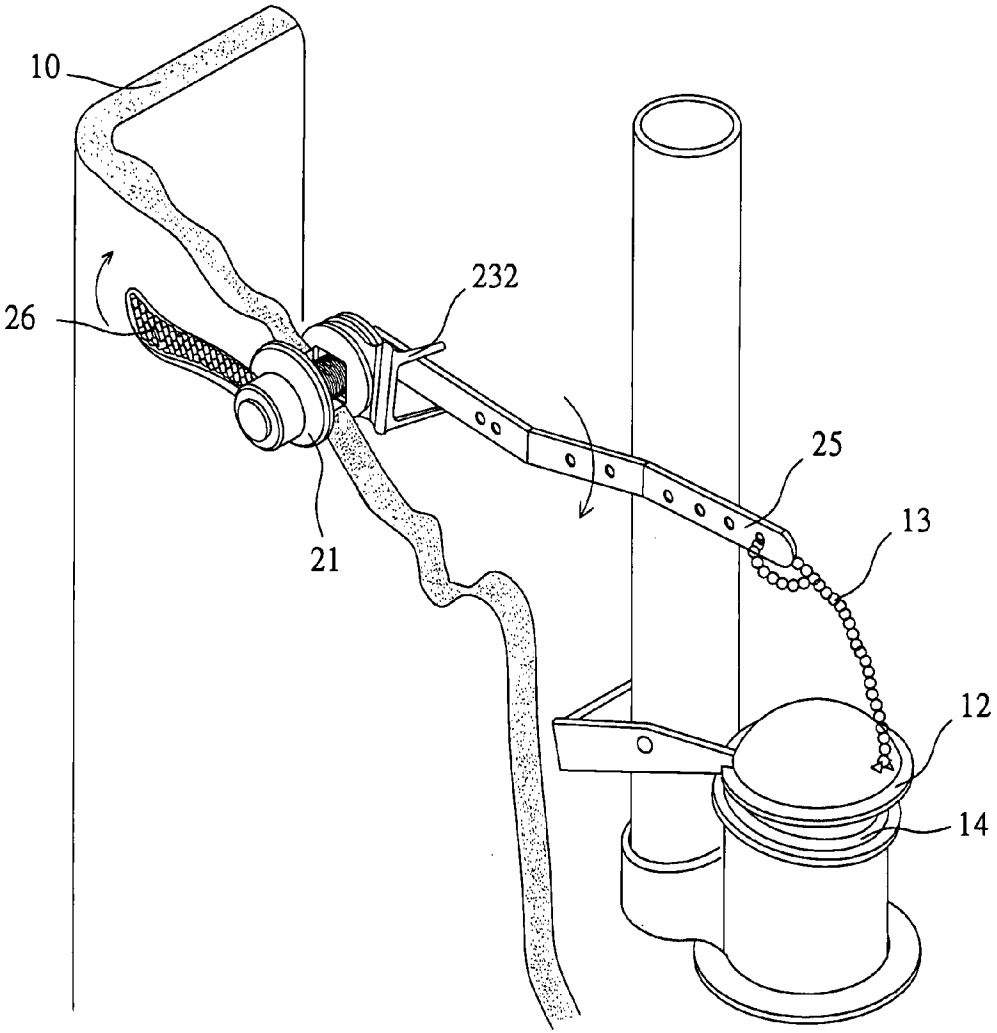
FIG. 5 is similar to FIG. 4 but showing the gripe mechanism is released to close the water stop valve.
Figure 6:
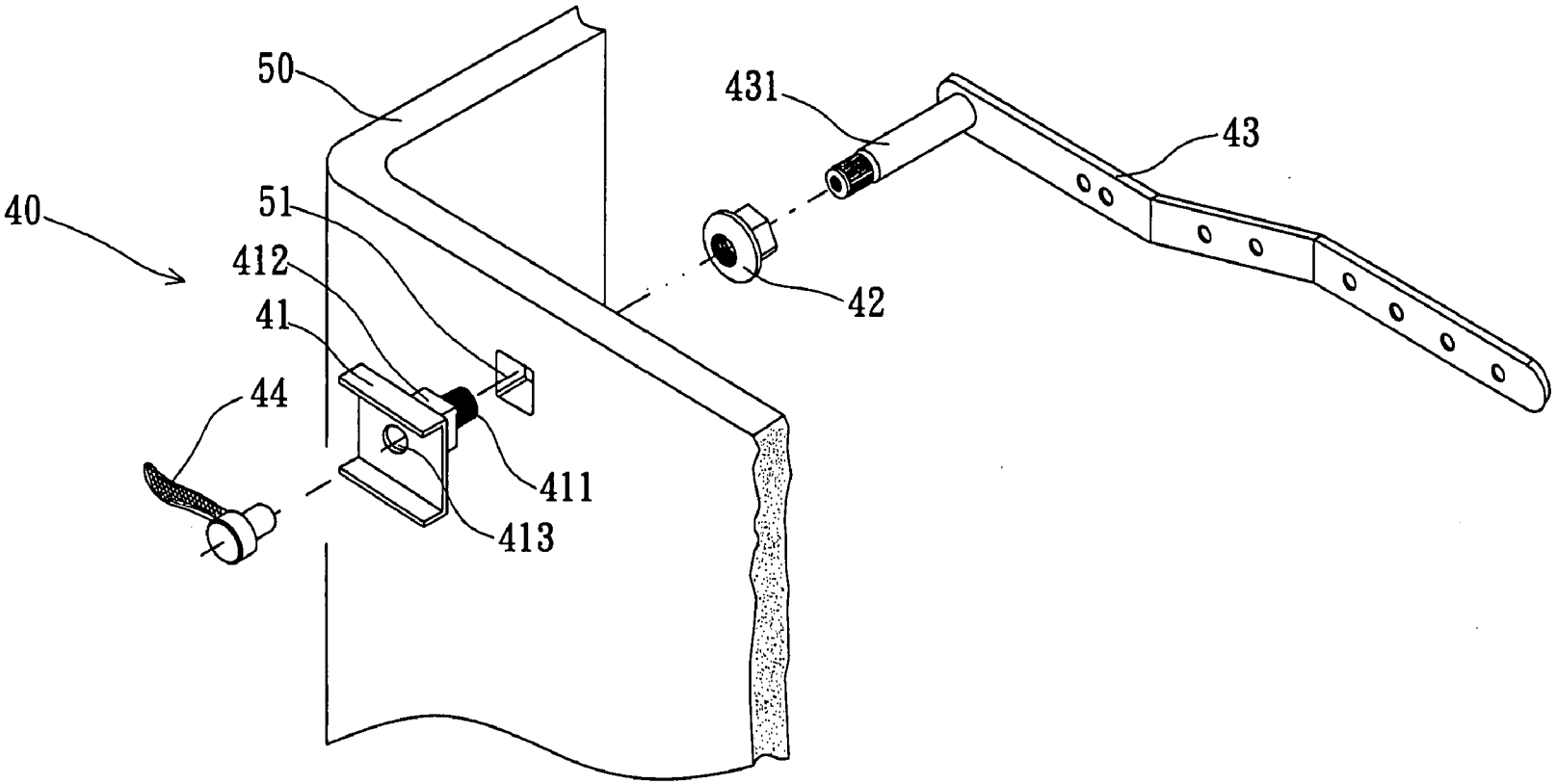
FIG. 6 PRIOR ART
FIG. 6 is an exploded view of a conventional gripe mechanism.

When the user releases the gripe 26, the water stop valve 12 returns to cover the outlet 14 due to its weight after the water in the reservoir tank 10 is drained (see FIG. 5). Then the reservoir tank 10 starts to store water for next use. Thus, it is ready to use the gripe mechanism 20.

Since the position limit member 23 of the gripe mechanism 20 has a plurality of evenly configured positioning cutouts 231, when the rectangular through hole 11 of the reservoir tank 10 is undesirably deflective, the positioning cutouts 231 are rotated to adjust the position thereof relative to the protrusion 241 of the positioning member 24 thereby keeping the position relationship between the position limit frame 232 of the position limit member 23 and the reservoir tank 10 desirable. Therefore, the lever 25 remains to move within a desirable scope thereby preventing from adversely affecting opening and closing of the water stop valve 12. Furthermore, the gripe mechanism 20 of the present invention is applicable to various types of reservoir tanks and is ready to assemble and adjust.

The quantity of the positioning cutouts 231 of the position limit member 23 of the present invention is a multiple of the shape of the protrusion 242 of the positioning member 24. For example, when the protrusion 242 of the positioning member 24 is a square, the quantity of the positioning cutouts 231 of the position limit member 23 may be 8, 12, 16, 20 and so on.

It is understood that the invention may be embodied in other forms without departing from the spirit thereof. Thus, the present examples and embodiments are to be considered in all respects as illustrative and not restrictive, and the invention is not to be limited to the details given herein.

The invention claimed is:

1. A gripe mechanism of a reservoir tank for a toilet bowl, assembled to a through hole defined in the reservoir tank, the gripe mechanism comprising:

a bolt, extending through the through hole of the reservoir tank;

a position limit member, located at an inner side of the reservoir tank with the bolt extending therethrough, a plurality of positioning cutouts being evenly defined in the position limit member, a position limit frame extending from the position limit member;

a positioning member, a screw hole being defined in the positioning member for engaging with the bolt, a protrusion extending from the positioning member towards the position limit member for extending through the positioning cutouts of the position limit member and into the through hole of the reservoir tank;

a lever, a projecting rod extending from an end of the lever for extending through the screw hole of the positioning member; and a gripe, connected to the projecting rod by a screw thereby linking the gripe to the lever, movement of the lever being limited by the position limit frame of the position limit member.

2. The gripe mechanism of a reservoir tank for a toilet bowl as claimed in claim 1, wherein the quantity of the positioning cutouts of the position limit member is configured to be a multiple of the shape of the protrusion of the positioning member.

3. The gripe mechanism of a reservoir tank for a toilet bowl as claimed in claim 1, wherein the position limit frame generally perpendicularly extends from the position limit member.

4. The gripe mechanism of a reservoir tank for a toilet bowl as claimed in claim 3, wherein the position limit frame of the position limit member is C-shaped.

5. The gripe mechanism of a reservoir tank for a toilet bowl as claimed in claim 1, wherein the position limit frame of the position limit member is C-shaped.

6. The gripe mechanism of a reservoir tank for a toilet bowl as claimed in claim 1, wherein a mating portion is formed at the free end of the projecting rod for connecting with the gripe.

7. The gripe mechanism of a reservoir tank for a toilet bowl as claimed in claim 1, wherein the through hole of the reservoir tank is rectangular, and the protrusion of the positioning member is rectangular.

* * * * *